US010765587B2

(12) United States Patent
Gardner et al.

(10) Patent No.: US 10,765,587 B2
(45) Date of Patent: Sep. 8, 2020

(54) WALKER ATTACHMENT FOR WHEELCHAIRS

(71) Applicant: GARDNER-GRAY, LLC, Shelbyville, KY (US)

(72) Inventors: Kenneth A. Gardner, Shelbyville, KY (US); William Whitie Gray, Shelbyville, KY (US)

(73) Assignee: GARDNER MEDICAL, LLC, Shelbyville, KY (US)

( * ) Notice: Subject to any disclaimer, the term of this patent is extended or adjusted under 35 U.S.C. 154(b) by 236 days.

(21) Appl. No.: 15/905,917

(22) Filed: Feb. 27, 2018

(65) Prior Publication Data

US 2018/0250188 A1 Sep. 6, 2018

Related U.S. Application Data

(60) Provisional application No. 62/467,307, filed on Mar. 6, 2017.

(51) Int. Cl.
*A61H 3/04* (2006.01)

(52) U.S. Cl.
CPC ..... *A61H 3/04* (2013.01); *A61H 2201/0107* (2013.01); *A61H 2201/0149* (2013.01); *A61H 2201/0192* (2013.01)

(58) Field of Classification Search
CPC ..... A61H 3/04; A61H 2201/0107; A61H 2201/0149; A61H 2201/0192
USPC ..... 280/250.1
See application file for complete search history.

(56) References Cited

U.S. PATENT DOCUMENTS

| | | | | |
|---|---|---|---|---|
| 2,556,121 A * | 6/1951 | Thomas | A61G 5/10 280/304.1 |
| 2,596,055 A * | 5/1952 | Thomas | A61H 3/00 280/304.1 |
| 2,958,067 A * | 10/1960 | Hardy | C09K 8/58 439/479 |
| 3,584,890 A | 6/1971 | Presty | |
| 3,999,778 A | 12/1976 | Markiel | |
| 4,342,465 A | 8/1982 | Stillings | |
| 4,431,076 A | 2/1984 | Simpson | |

(Continued)

FOREIGN PATENT DOCUMENTS

| | | |
|---|---|---|
| GB | 2105268 A | 3/1983 |
| JP | 2014030692 A | 2/2014 |
| WO | WO2016010863 | 1/2016 |

OTHER PUBLICATIONS

English Machine translation of JP2014030692A.

*Primary Examiner* — Jacob D Knutson
(74) *Attorney, Agent, or Firm* — King & Schickli, PLLC

(57) ABSTRACT

A walker adapted for attachment to a wheelchair may be used to assist a user with walking while retaining the wheelchair in close proximity behind the user for use when the user needs to sit. The walker may be removably attached to the frame of the wheelchair for easy exchange of use from one wheelchair to another. A pivotable, removably attachable gate between two vertical rods may allow for the walker to be manipulated from a walking position to a stored position. The gate may include an extendable width to allow for use with wheelchairs of different widths. Telescopic supports may attach the walker to the wheelchair, thereby allowing the user to extend and retract the walker between the walking position and the stored position.

15 Claims, 7 Drawing Sheets

(56) References Cited

U.S. PATENT DOCUMENTS

| | | | | |
|---|---|---|---|---|
| 4,830,035 | A * | 5/1989 | Liu | A61H 3/00 135/67 |
| 4,934,725 | A | 6/1990 | Owens | |
| 4,948,156 | A * | 8/1990 | Fortner | A61G 5/14 180/907 |
| 5,005,599 | A * | 4/1991 | Cunningham | A61H 3/00 135/67 |
| 5,277,438 | A | 1/1994 | Chuang | |
| 5,419,571 | A | 5/1995 | Vaughan | |
| 5,445,174 | A * | 8/1995 | Cunningham | A61G 7/053 135/66 |
| 7,377,285 | B2 | 5/2008 | Karasin et al. | |
| 7,481,445 | B1 | 1/2009 | Danziger | |
| 7,500,689 | B2 | 3/2009 | Pasternak et al. | |
| 7,651,649 | B2 * | 1/2010 | Obitts | A61H 3/00 264/242 |
| 7,703,465 | B2 * | 4/2010 | Diamond | A45B 7/00 135/67 |
| 8,998,244 | B2 | 4/2015 | Purdue | |
| 9,351,901 | B1 * | 5/2016 | Petsch | A63B 22/001 |
| 2011/0006494 | A1 | 1/2011 | Walker | |
| 2016/0022517 | A1 | 1/2016 | Frangos et al. | |
| 2016/0184167 | A1 * | 6/2016 | Naucke | A61H 3/04 280/47.4 |
| 2018/0104133 | A1 * | 4/2018 | Chen | A61G 5/10 |

* cited by examiner

WALKER ATTACHMENT FOR WHEELCHAIRS

This application claims priority to U.S. PROVISIONAL Application Ser. No. 62/467,307, filed Mar. 6, 2017, the disclosure of which is hereby incorporated by reference in its entirety.

TECHNICAL FIELD

This invention concerns a walker attachment for wheelchairs. More specifically it is a device that can be attached to any manually operated wheelchair, either for short-term or long-term use and once attached provides a walker function that can be used as needed.

BACKGROUND OF THE INVENTION

Wheelchairs are mobility devices that are used primarily by two groups of individuals. One group includes long-term patients who are chronically weak or ill and the other are short-term patients who are in rehabilitation programs such as after a trauma or surgery. Many patients who are long-term wheelchair users still maintain the ability to walk short distances unsupervised. They however, require the use of a walker for such ambulation. Usually the distances they can walk before needing to sit and rest is often limited. Long-term care facilities lack the staffing to supervise such brief episodes of walker-assisted ambulation so most residents are relegated to spending almost all of their time in a wheelchair. This puts patients at higher risk for dependent edema, pressure ulcers, and thrombophlebitis (blood clots).

The other primary group of wheelchair users includes patients who are non-ambulatory for short periods such as when recovering from trauma or a major surgery such as hip or knee replacement. Many of these patients also need a wheelchair intermittently, in between walker use.

Traditionally, in order for a wheelchair user to transition to use of a walker, a separate walker device is needed. This normally requires participation of a second assistant other than the wheelchair user, such as a nurse, physical therapist, family member, or other medical assistant.

Accordingly, a need has been identified for a device that would allow the wheelchair user to transition to a walker that may not require assistance from a third person.

SUMMARY OF THE INVENTION

In one embodiment, the invention generally relates to a walker for use by a user, the walker adapted for connection to a wheelchair including a frame. The walker comprises a first vertical rod and a second vertical rod adapted to assist in supporting the user when the walker is in a walking position. In addition, the walker includes a gate rotatable about a longitudinal axis of the first vertical rod, said gate being removably connectable to the second vertical rod, wherein the gate is connected to the second vertical rod in the walking position and is disconnected from the second vertical rod in a stored position. At least two wheelchair attachment supports are adapted for removable connection to the frame of the wheelchair when the walker is in the walking position.

In one aspect, the wheelchair attachment supports comprise an outer support tube and an inner support tube adapted to telescopically slide with respect to the outer support tube between an extended condition and a retracted condition. The supports may further include a stop adapted to selectively limit a distance that the inner support tube may telescope with respect to the outer support tube. The extended condition of the wheelchair attachment supports may correspond to the walking position of the walker, and the retracted condition of the wheelchair attachment supports may correspond to the stored position of the walker.

The walker may further include at least one clamp assembly associated with each of the wheelchair attachment supports, said clamp assembly adapted for removable connection of the each of the wheelchair attachment supports and the frame of the wheelchair when the walker is in the walking position. The at least one clamp assembly comprises a clamp body including a recess defined by a base connecting two sides, and the clamp assembly further comprises a sliding head adapted to slide within the recess to capture and hold one of the wheelchair attachment supports and the frame of the wheelchair within the clamp body.

The first vertical rod and the second vertical rod each may include a wheel at a bottom and a handle at the top, said handle adapted for gripping by the user when the walker is in the walking position.

A retainer may be provided to attach the gate to one of the wheelchair attachment supports when the walker is in the stored position.

In another aspect of the invention, a walker is provided for use by the user, said walker adapted for connection to a wheelchair including a frame, the walker comprising two vertical rods adapted to assist in supporting the user when the walker is in a walking position. The walker may include a gate rotatably connected to a first of the two vertical rods and removably connectable to a second of the two vertical rods, wherein the gate is connected to the second of the two vertical rod in the walking position and is disconnected from the second of the two vertical rods in a stored position. At least two wheelchair attachment supports may be provided, each of said supports extending from a corresponding one of the two vertical rods, wherein each of the supports includes at least one clamp assembly adapted to removably connect each of the supports to the frame of the wheelchair when the walker is in the walking position.

The walker may further include two braces, each of said two braces connecting one of the at least two wheelchair attachment supports to a corresponding one of the two vertical rods.

The two vertical rods may be adapted to be the only portions of the walker contacting a floor beneath the walker when the walker is in the walking position. Each of the two vertical rods may comprise a wheel, and the wheel may be adapted to contact the floor when the walker is in the walking position.

In one aspect, the at least one clamp assembly comprises a clamp body including a recess defined by a base connecting two sides, and the clamp assembly further comprises a sliding head adapted to slide within the recess to capture and hold one of the wheelchair attachment supports and the frame of the wheelchair within the clamp body. The clamp assembly may further include a screw adapted to move the sliding head within the recess. The clamp body may include an aperture through said clamp body for receiving the screw, said aperture including a longitudinal axis forming an angle greater than zero degrees with the base of the clamp body.

In another aspect of a walker for use by a user and adapted for connection to a wheelchair including a frame, a first vertical rod and a second vertical rod may be adapted to assist in supporting the user when the walker is in a walking position. The walker may further comprise a gate rotatably connected to the first vertical rod and removably connectable to the second vertical rod, wherein the gate is connected to the second vertical rod in the walking position and is disconnected from the second vertical rod in a stored position. At least two telescoping wheelchair attachment supports may be provided, each of said supports extending posteriorly from one of the first vertical rod or the second vertical rod and adapted for removable connection to the frame of the wheelchair, wherein the telescoping wheelchair attachment supports are in an extended condition when the walker is in the walking position and are in a retracted condition when the walker is in the stored position.

Each of the at least two telescoping wheelchair attachment supports may include an outer tube and an inner tube adapted to move longitudinally with respect to each other. The walker may further include at least one bearing between the outer tube and the inner tube. At least one stop may be provided in association with the telescoping wheelchair attachment supports, said stop adapted to limit relative movement of the inner tube with respect to the outer tube. In the walking position, the supports are attached to the frame of the wheelchair and are telescopically extended to the at least one stop.

DETAILED DESCRIPTION OF THE INVENTION

The description provided below and in regard to the figures applies to all embodiments unless noted otherwise, and features common to each embodiment are similarly shown and numbered.

Figure 1:
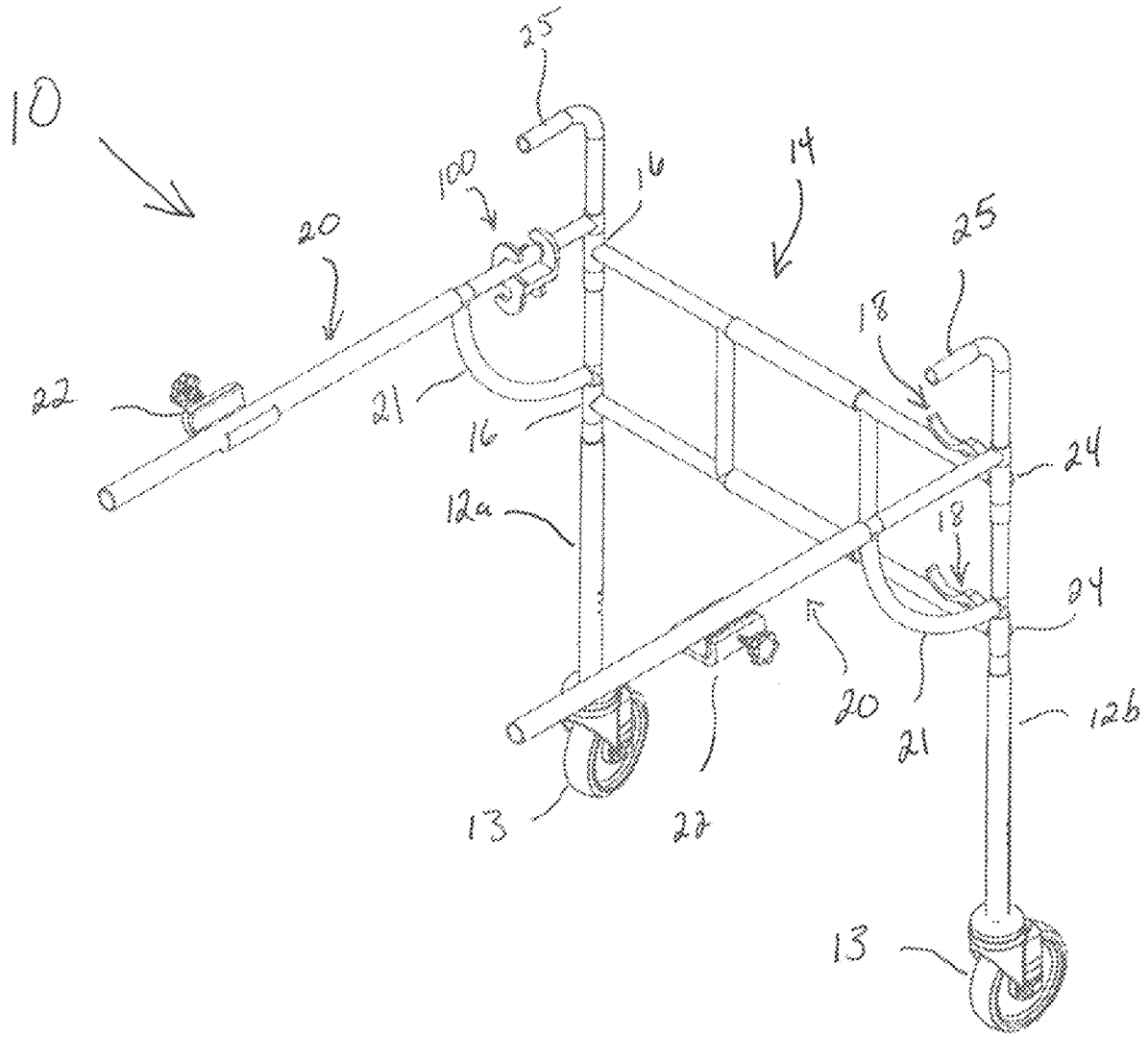
FIG. 1 is a rear perspective view of an embodiment of a walker of the present invention.

With reference to FIG. 1, a walker 10 is disclosed for use with a wheelchair W. The walker 10 may include a plurality of legs such as vertical rods 12, which may be connected by a horizontal support such as gate 14. As illustrated in FIG. 1, the vertical rods 12 may comprise a first vertical rod 12*a* and a second vertical rod 12*b*. The first and second vertical rods 12*a*, 12*b* may be left and right vertical rods. The plurality of legs may be in the form of only the first and second vertical rods 12*a*, 12*b*, with no further legs or other vertical supports supporting the weight of the walker. Each vertical rod 12*a*, 12*b* may include a wheel 13 at a lower end of the vertical rod for assisting the user in moving the walker, such as in the form of a swivel caster. The vertical rods 12*a*, 12*b* may further include a handle 25 at an upper end of the vertical rods for a user to grip when using the walker 10 for assistance with walking.

Figure 2:
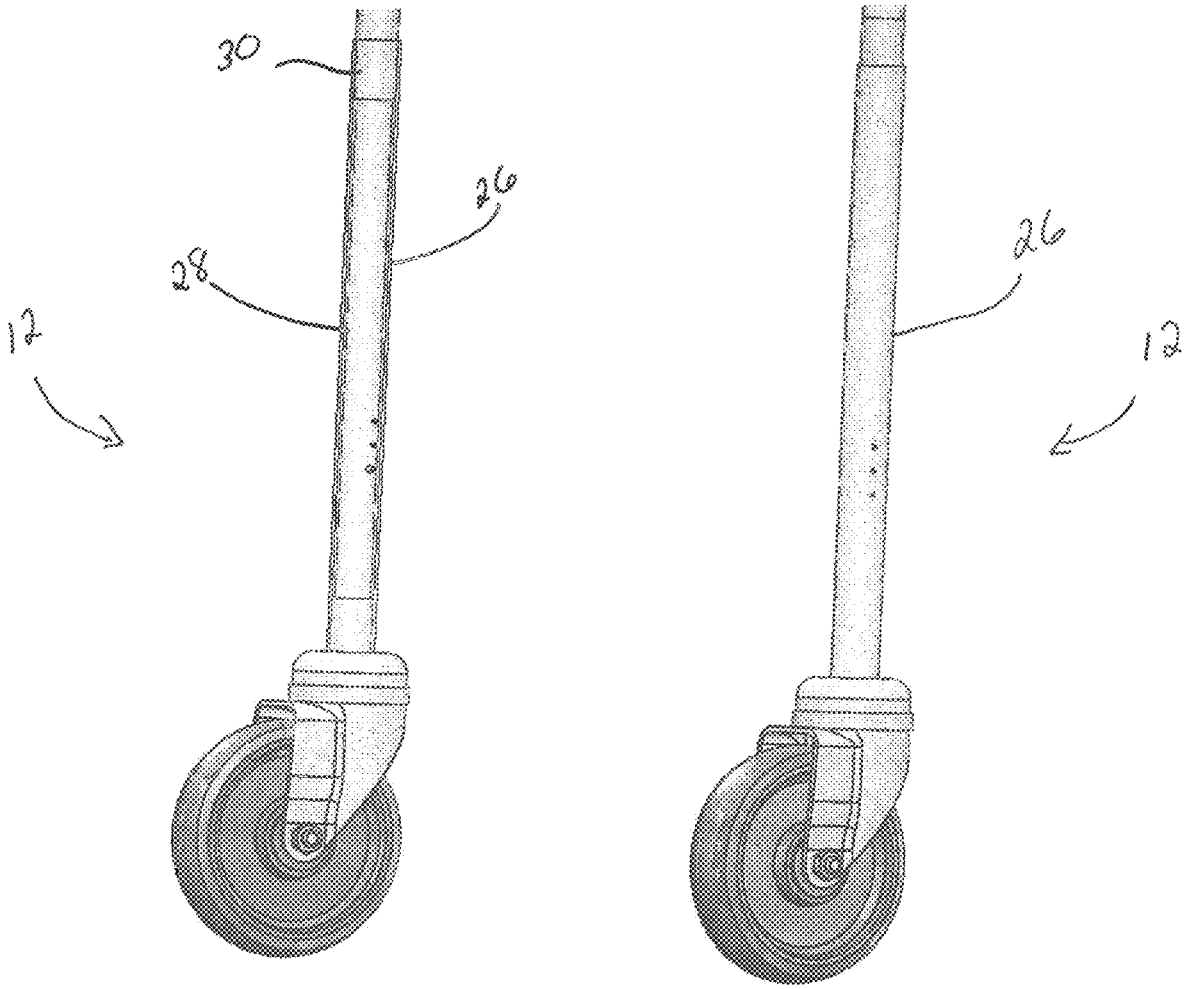
FIG. 2 is a front view of the legs of the walker of FIG. 1.

As is illustrated in FIG. 2, the vertical rods 12 may be telescoping in nature. For example, the vertical rods 12 may comprise an outer telescoping tube 26, which may slidably fit over an inner telescoping tube 28. As shown, the outer telescoping tube 26 of the left vertical rod 12 is shown as transparent so that the inner telescoping tube 28 may be seen. One or more bearings 30 may be provided for assisting the inner and outer telescoping tubes in expanding and contracting the length of the vertical rods 12. As illustrated, the bearings 30 may comprise sleeve bearings that may be press fit into the outer telescoping tube 26. One or more locking mechanisms may be provided for locking the relative longitudinal movement between the inner and outer telescoping tubes 26, 28, such as detents (e.g. detent plungers) and matching apertures.

Returning to FIG. 1, the gate 14 may be adapted to removeably, laterally attach the vertical rods 12*a*, 12*b* to one another when the walker 10 is in use. The use of the gate 14 provides stability to the walker and prevents relative movement between the vertical rods 12*a*, 12*b*. In one aspect, the gate 14 may be pivotally connected to a first vertical rod 12*a*, such as by one or more hinges 16. These hinges 16 may allow the gate 14 to pivot for connection with the second vertical rod 12*b* when the walker 10 is in use, and pivot away from the second vertical rod 12*b* when the walker 10 is not in use. In one aspect, these hinges may allow for at least 270 degrees of rotation of the gate about the hinge.

One or more gate latches 18 may be provided for removably fixing the gate 14 to the second vertical rod 12*b* when the walker is in use. The latches may allow for a user to attach the rotating gate 14 to the second vertical rod 12*b* when the walker is in use, and release the rotating gate 14 from the second vertical rod 12*b* when the walker is not in use, such as for storage. As will be described in further detail with respect to FIGS. 6A and 6B, one or more stops 24 may be provided for contacting the second vertical rod 12*b* and preventing further rotation of the gate 14.

The walker 10 may further include a plurality of wheelchair attachment supports 20 for connecting the vertical rods 12 to the wheelchair W. These supports 20 may extend from the vertical rods 12, such as in a generally horizontal direction, and may comprise beams, poles, or pipes. One or more braces 21 may be provided for connecting the supports 20 to the vertical rods 12, such as for bracing the supports 20 and maintaining a relative position between the supports 20 and the vertical rods 12. One or more clamp assemblies 22 may be provided for attaching the supports 20 to the wheelchair W, thereby providing a vertical support for the walker 10 rearward of the vertical rods 12. In one aspect, a plurality of clamp assemblies 22 may be adapted for use with each support 20.

Figure 3:
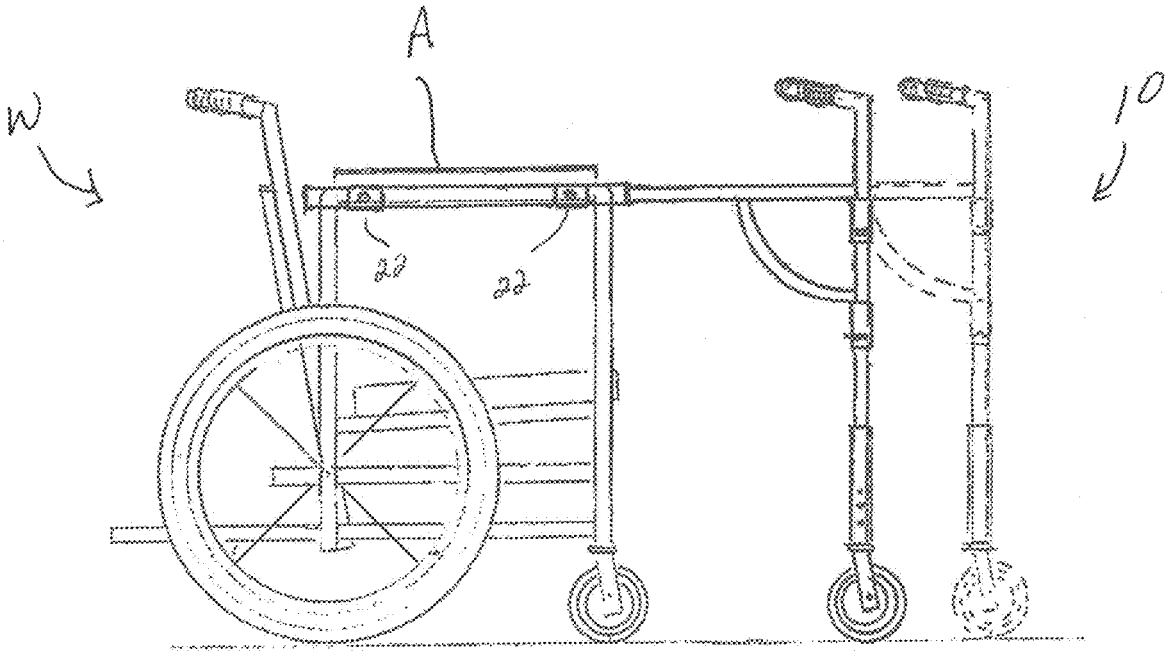
FIG. 3 is a side view of the walker of FIG. 1 attached to a wheelchair.
Figure 5A:
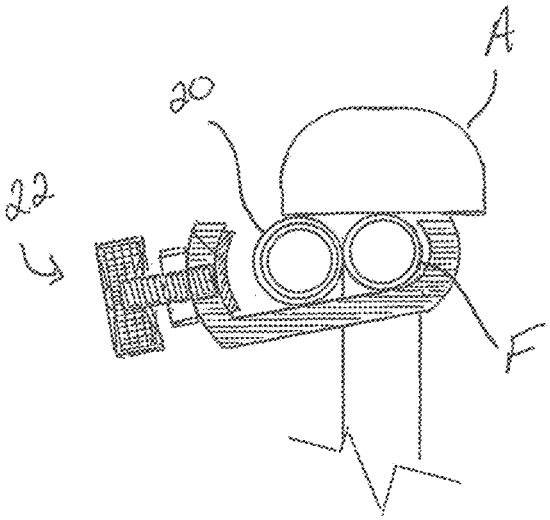
FIGS. 5A-5C illustrate a clamp assembly.

As can be seen in FIG. 3 and FIG. 5A, the clamp assemblies 22 may be adapted to removably connect the supports 20 to a frame F of the wheelchair W. The term "removably connect" means that a first element, such as the clamp assembly 22, is adapted to connect to a second element, such as the frame F of the wheelchair W, and be removed therefrom without the assistance of tools. As will be discussed in further detail below, the clamp assemblies 22 may be adapted for easy connection and removal from the frame F by the user without the assistance of any third party. In use, the walker 10 may remain attached to the wheelchair W by way of the clamp assemblies 22 when the walker is in the walking position as described herein, thereby affording the user the ability to sit down in the wheelchair whenever the user tires from using the walker. This may reduce the risk of the user falling from fatigue, such as may result by use of a traditional walker that is separate from a wheelchair.

The clamp assemblies 22 may be adapted for attachment and removal from frame F of the wheelchair W in a manner that allows the supports 20 to be connected to the frame F at different positions with respect to the wheelchair. For example, as illustrated in FIG. 3, the clamp assemblies 22 may attach the supports 20 to the frame F of the wheelchair W at a first forward position, and at a second, rearward position. This allows the user to locate the walker 10 at fixed relative positions with respect to the wheelchair W. Such manipulation of the relative position of the walker 10 with respect to the wheelchair W by way of the removable connection via the clamp assemblies 22 allows for users of different body sizes to use the walker 10 for assistance with walking (e.g. users with different arm lengths or different body proportions). Additionally, the manipulation of the relative position of the walker 10 with respect to the wheelchair W by way of the removable connection via the clamp assemblies 22 allows for a user to manipulate the walker from a walking position to a stored position. Furthermore, this manipulation of position of the walker 10 by way of the clamp assemblies 22 allows for the walker 10 to be used with wheelchairs W of different sizes.

Figure 4:
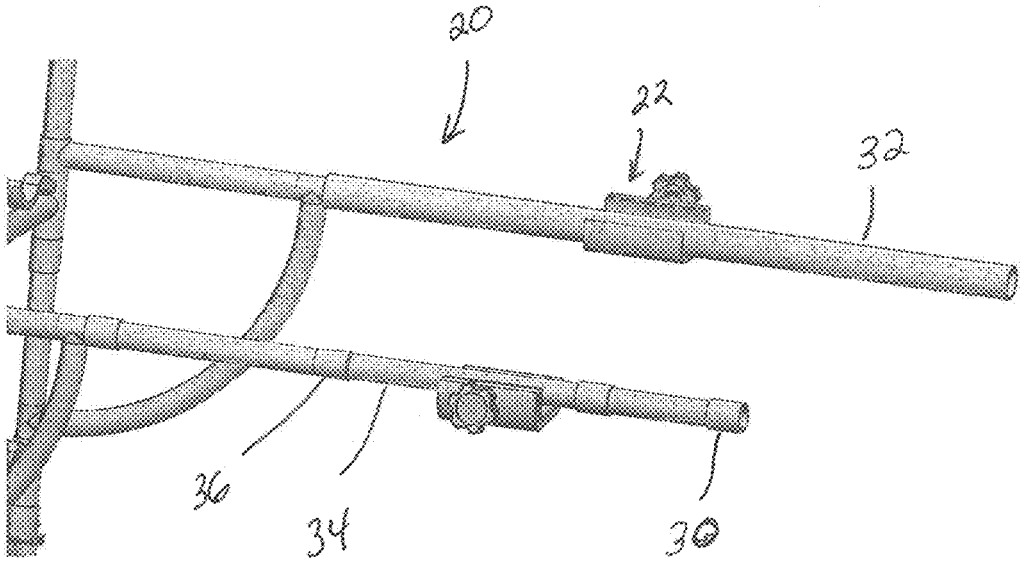
FIG. 4 is a perspective view of the supports of the walker of FIG. 1.

With reference to FIG. 4, the wheelchair attachment supports 20 are illustrated in further detail. In one aspect, the supports 20 may be telescoping in nature, thereby further assisting the user in adjusting the configuration of the walker 10 as needed. The supports 20 may include an outer tube 32 and an inner tube 34 that are adapted to slide longitudinally with respect to one another. One or more bearings 30, such as sleeve bearings, may be provided for assisting in the telescoping of the outer and inner tubes 32, 34. These sleeve bearings may be press fit into the outer tube 32, or may be press fit onto the inner tube 34.

One or more stops 36 may be provided for limiting the relative longitudinal positions of the outer and/or inner telescoping tubes 32, 34. As illustrated, the stop 36 may comprise a radially extending element attached to the inner tube 34 which may prevent further longitudinal movement of the outer tube 32 beyond said stop. In one aspect, the stop 36 may comprise one or more detents (such as detent plungers) associated with the inner tube, which are adapted to mate with one or more apertures associated with the outer tube. The stop 36 may be positioned at a medically relevant position, such as at a distance large enough to allow the user to stand from the wheelchair W and use the walker 10 with sufficient room between the walker 10 and the wheelchair W for the user's legs to be used to ambulate. In one example, the stop 36 may be positioned approximately 15 inches along the inner tube 34 from the vertical rod 12. The stop 36 may be positioned so as to allow the walker 10, once attached to the frame F of the wheelchair W, to be extended by the user by way of the telescoping nature of supports 20 from the stored position to the walking position.

Figure 5B:
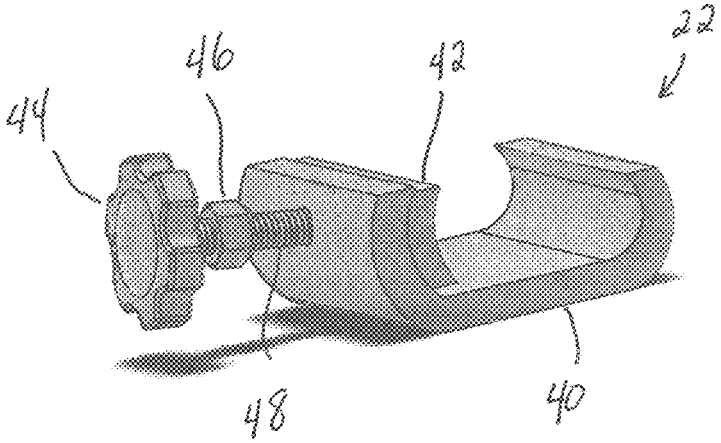
Figure 5C:
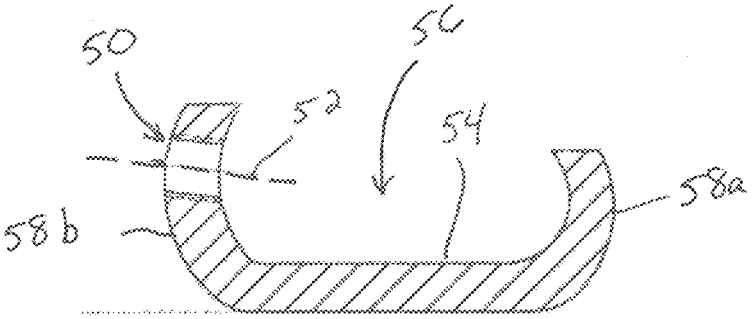

With further reference to FIGS. 5A-5C, the details of the clamp assembly 22 are further indicated. The clamp assembly 22 may include a clamp body 40, which may include a base 54 located between first and second sides 58*a*, 58*b*. The sides 58*a*, 58*b* may be arcuate in cross-section so as to coordinate with a rounded frame element F associated with an arm A of the wheelchair W and/or with a rounded support 20 of the walker 10. The curved nature of the sides 58*a*, 58*b* may cushion and/or prevent movement of the walker 10 with respect to the frame F when the clamp assembly 22 is in use. The base 54 and sides 58*a*, 58*b* may define a recess 56 therebetween. As can be seen in FIG. 5A, the clamp assembly 22 may be adapted to hold both a portion of the frame F of the wheelchair W and the support 20 of the walker 10 within the recess 56 of the clamp assembly 22.

The clamp assembly 22 may further include a sliding head 42. The sliding head 42 may be adapted for movement within the recess 56 of the body 40 and be adapted to apply a pressure to a body within the clamp assembly 22, thereby fixing the clamp assembly in place. The sliding head 42 may also be arcuate in cross-section so as to coordinate with a rounded frame element F or a rounded support 20 of the walker 10. With further reference to FIG. 5A, upon placement of both a portion of the frame F of the wheelchair W and the support 20 of the walker 10 within the recess 56, the sliding head 42 may be actuated from the second side 58*b* toward the first side 58*a* of the body 40, thereby applying pressure to both the support 20 and the frame F of the wheelchair W, and fixing the walker 10 to the wheelchair W.

The clamp assembly 22 may include a screw 44 adapted to move the sliding head 42 back and forth within the body 40 of the clamp assembly 22. The screw 44 may pass through an aperture 50 in the body 40. The aperture 50 may be threaded to receive the screw, or a helical insert 48 may be provided within the aperture 50 for receiving the screw 44. A locking nut 46 may be provided for limiting the distance that the screw 44 may travel, thereby limiting the range of motion of the sliding head 42 within the recess 56. In one aspect, the aperture 50 may be oriented with a longitudinal axis 52 which is offset at an angle from the base 54 of the body 40. This offset angle may cause the screw 44 to apply a force to the sliding head 42 that has both a horizontal factor across the recess 56 from one side 58*b* to the other side 58*a*, as well as a vertical factor from a top of the recess 56 toward the base 54 of the body 40. This directional force applied to the sliding head 42 by way of the angled orientation of the aperture 50 biases the support 20 and the frame F of the wheelchair downward and into the first side 58*a* of the clamp body 40, thereby better securing the walker 10 and wheelchair W to one another. Overall, the screw-based attachment and disengagement of the clamp assembly 22 allows the user to easily attach, disengage, and reposition the walker 10 with respect to the wheelchair W. this is at least because the attachment location of the walker 10 to the wheelchair W is along the armrest A of the wheelchair W, which is easily accessible to the user.

Figure 6:
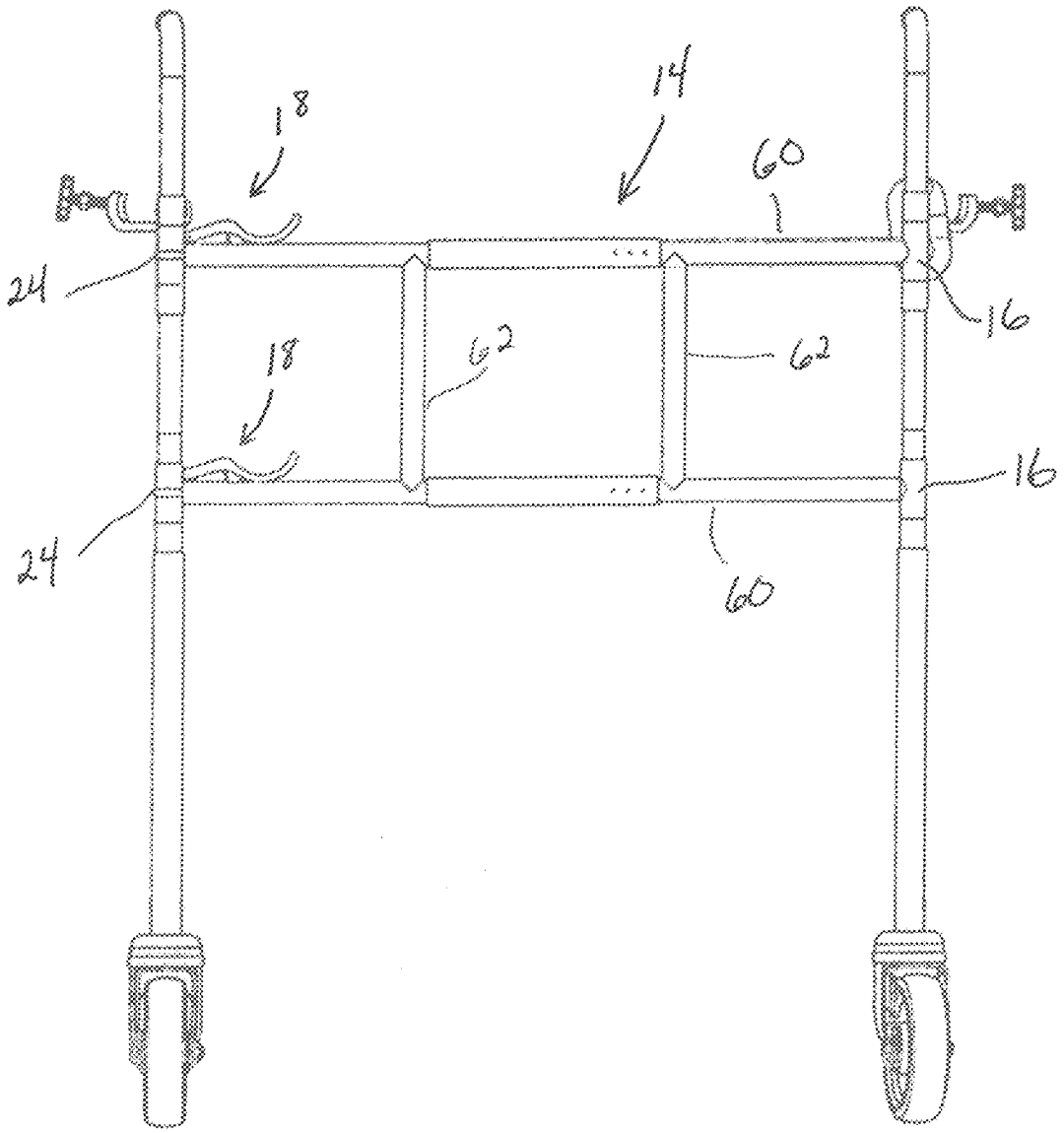
FIG. 6 is a front view of the walker of FIG. 1 in the walking position.

Turning to FIG. 6, the gate 14 may be seen from the front of the walker. The gate 14 may include one or more cross beams 60. The cross beams 60 may span from the first vertical rod 12*a*, connected at the hinge 16, to the stop 24, said stop 24 adapted to contact the second vertical rod 12*b* when the gate 14 is in the closed configuration. This closed configuration may be achieved by joining the gate 14 with the second vertical rod 12*b* by way of the latch 18. In the embodiment in which a plurality of cross beams are present, as is illustrated in FIG. 6, one or more connecting beams 62 may be provided. These connecting beams 62 connect the cross beams 60 and provide support and stability to the gate. As illustrated, the cross beams 60 are substantially horizontal and the connecting beams 62 are substantially vertical.

Figure 7A:
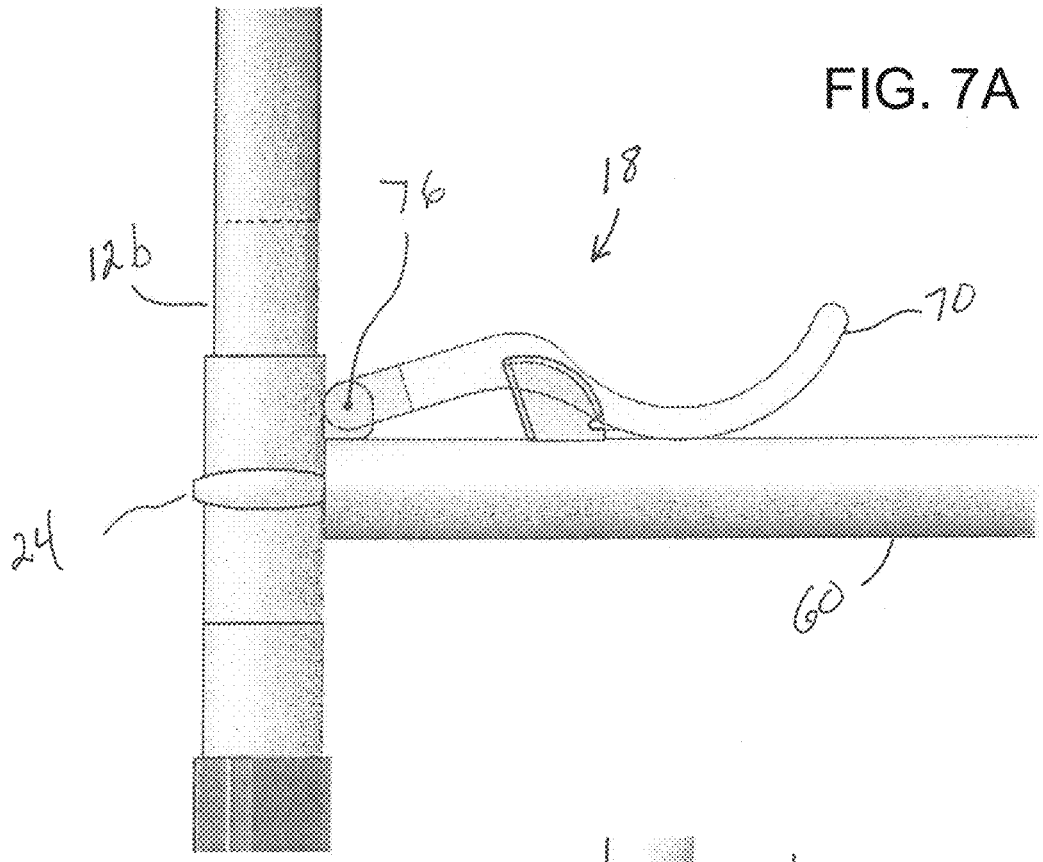
FIGS. 7A and 7B illustrate a latch of the gate of the walker of FIG. 1.
Figure 7B:
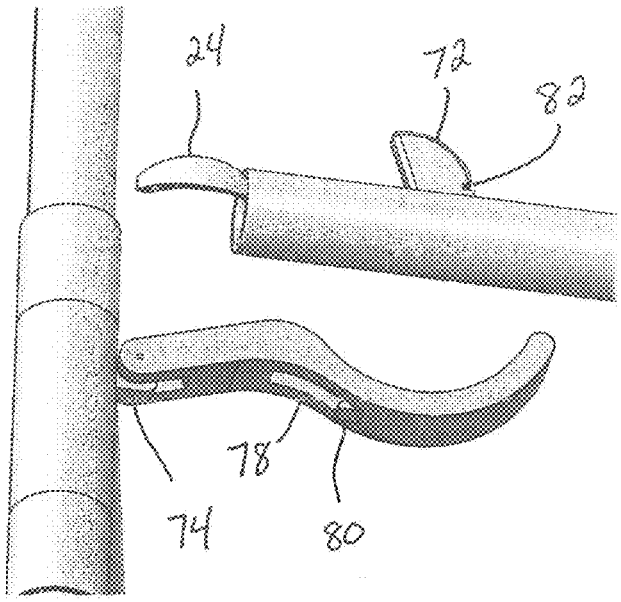

The latch 18, as illustrated in FIGS. 7A and 7B, may be used to attach the pivotable gate 14 to the second vertical rod 12*b*. FIG. 7A illustrates the latch 18 in the closed configuration, while FIG. 7B illustrates the latch 18 in the open configuration. The latch may include a lever arm 70 attached to the second vertical rod 12 by, such as by anchor 74. The lever arm 70 may be adapted to rotate with respect to the anchor 74, such as via a spring pin 76. The spring pin 76 may bias the lever arm 70 in a given direction, such as downward. The gate 14 may include a catch 72 for engaging the lever arm 70 when the latch 18 is in the closed configuration. The catch 72 may be located on a cross beam 60 of the gate 14. In practice, the catch 72 may be received by the lever arm 70, such as within recess 78. As illustrated, the catch 72 may be arcuate in shape along a top of the catch in order to facilitate the receipt of the catch 72 by the recess 78. In order to further secure the latch 18 in the closed configuration, the lever arm 70 may include a lip 80 that may be received by a notch 82 associated with the catch 72.

In use, the user may swing the gate 14 from the stored position to the walking position in which the gate 14 is attached to the second vertical rod 12*b*. As the gate 14 approaches the second vertical rod 12*b*, the user may raise the lever arm 70 and cause the stop 24 to contact the second vertical rod 12*b*. The lever arm 70 may then be rotated down over the catch 72 in order to secure gate 14 in connection with the second vertical rod 12*b*. The lip 80 may engage the notch 82 as the catch 72 is received within the recess 78 of the lever arm 70, thereby locking the walker 10 in the walking configuration.

Figure 8:
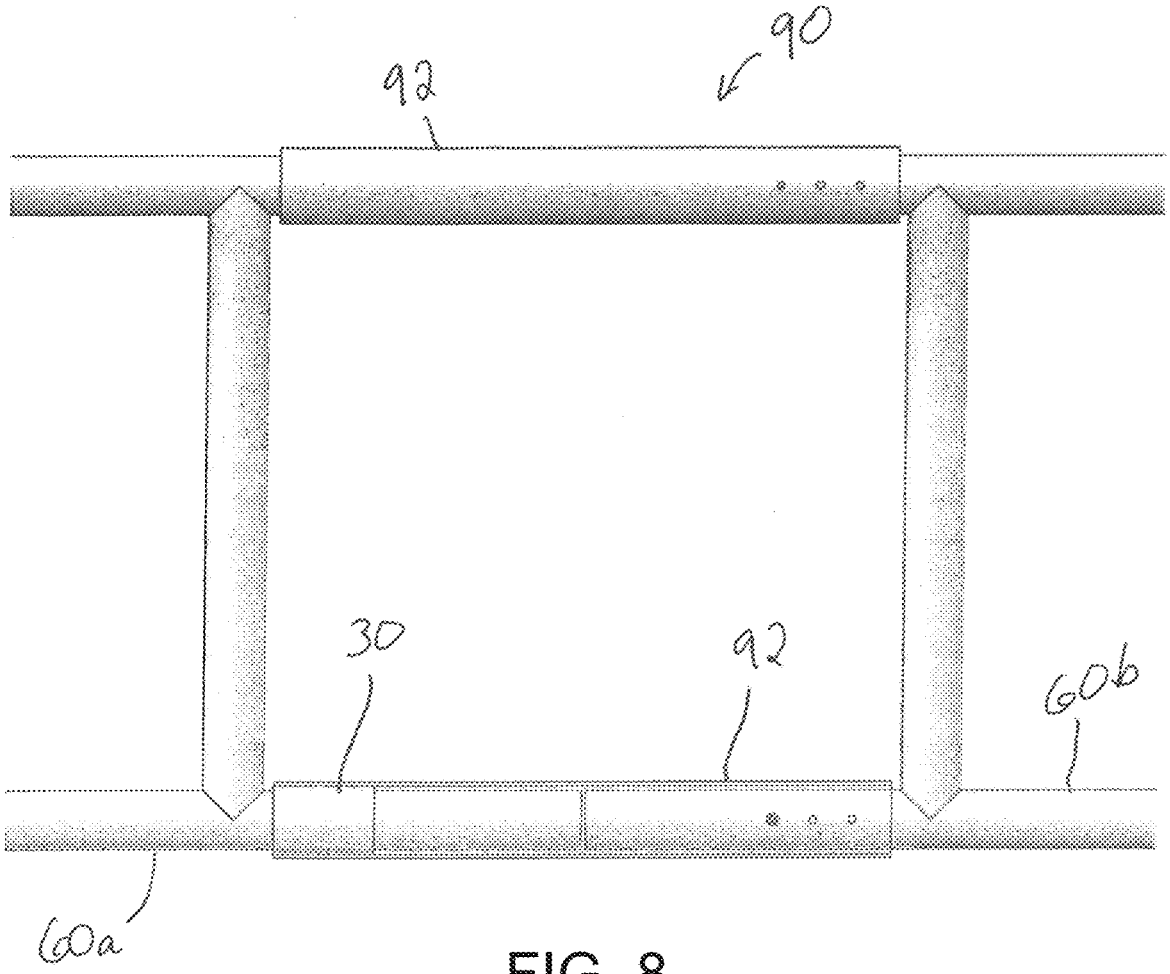
FIG. 8 is a front view of the expandable section of the gate of the walker of FIG. 1.

With further reference to FIG. 8, the gate 14 is illustrated with an extendible section 90. The extendible section may be adapted to allow a width of the gate to be expanded from a first width to a second width. This ability to expand the width of the gate 14 allows the walker 10 to be utilized with different wheelchairs W of different widths.

As illustrated, the extendible section 90 may comprise an outer tube 92, which may be positioned over the cross beam 60. As shown in FIG. 8, the cross beam 60 may comprise a first cross beam section 60*a* that aligns with but is separated from a second cross beam section 60*b*. The lower of the two outer tubes 92 of FIG. 8 is shown as transparent so that the first cross beam section 60*a* and the second cross beam section 60*b* may be seen. The outer tube 92 may receive at least a portion of the first cross beam section 60*a* and the second cross beam section 60*b*, and may allow relative longitudinal movement of at least one of the first cross beam section 60*a* and the second cross beam section 60*b* within the outer tube 92. One or more bearings 30 may be provided for facilitating relative longitudinal movement between the outer tube 92 and at least one of the first and second cross beam sections 60*a*, 60*b*.

One or more stops may be provided for preventing and allowing relative movement between the outer tube 92 and at least one of the first and second cross beam sections 60*a*, 60*b*. For example, one or more detents (such as detent plungers) may be associated with the first and/or the second cross beam sections 60*a*, 60*b*, which may be adapted to coordinate with one or more apertures on the outer tube 92. Actuation of the detent may allow for the outer tube 92 to slide with respect to one or more of the first and second cross beam sections 60*a*, 60*b*, such as for a fixed distance, until the detent moves from a first aperture in the outer tube 92 to a second aperture in the outer tube. This movement of the outer tube 92 with respect to at least one of the first and second cross beam sections 60*a*, 60*b* allows for expansion and contraction of the width of the gate 14.

Referring again to FIG. 1, a retainer 100 may be provided for retaining the gate 14 in the stored position. When the latch 18 is released and the gate 14 is disconnected from the second vertical rod 12*b*. The gate 14 may be adapted to rotate about the first vertical rod 12*a* by way of hinges 16 into the stored position. For example, the gate 14 may be rotated approximately 270 degrees from the walking configuration until the cross beams 60 of the gate 14 are substantially parallel with the support 20 extending from the first vertical rod 12*a*. The retainer 100 may be used to lock the gate 14 in this position. Once the gate has been rotated into the stored position, the wheelchair W may be used as a wheelchair with the user seated therein without interference from the walker 10, but while the walker 10 remains attached to the wheelchair. When the user wishes to use the walker 10 again, the gate 14 may be released from the retainer 100 and rotated about hinges 16 until it may be reattached to the second vertical rod 12*b* again.

Figure 9:
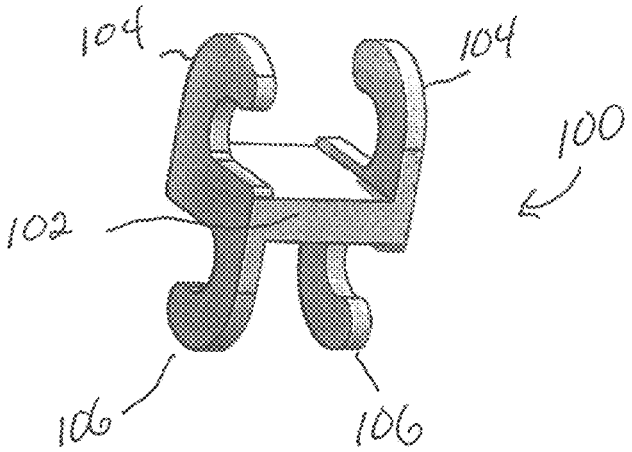
FIG. 9 is a perspective view of a retainer for locking the gate of the walker of FIG. 1 in a stored position.

With further reference to FIG. 9, one embodiment of the retainer 100 will be described in further detail. As shown, the retainer 100 includes a base 102 from which one or more first extensions 104 and one or more second extensions 106 extend. The first extensions 104 may be adapted to attach the retainer to the support 20 attached to the first vertical rod 12*a*. The second extensions 106 may be adapted to attach the gate 14 to the retainer 100 when the walker is in the stored position. As illustrated, the first extensions 104 comprise laterally spaced, oppositely facing arc-shaped members. These oppositely facing arc-shaped members are adapted to retain the support 20 therebetween. Similarly, the second extensions 106 comprise laterally spaced, oppositely facing arc-shaped members, which are adapted to retain a cross beam 60 of the gate 14 therebetween. In one aspect, the retainer 100 may be made of a flexible material, such that the extensions 104, 106 are adapted to bend to allow the support 20 and the cross beam 60, respectively, to be placed between said extensions. For example, the retainer may be made at least partially of rubber or plastic.

While the invention has been described with reference to specific examples, it will be understood that numerous variations, modifications and additional embodiments are possible, and all such variations, modifications, and embodiments are to be regarded as being within the spirit and scope of the invention. Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. A walker for use by a user, said walker adapted for connection to a wheelchair including a frame, the walker comprising:

a first vertical rod and a second vertical rod adapted to assist in supporting the user when the walker is in a walking position;

a gate rotatable about a longitudinal axis of the first vertical rod, said gate being removably connectable to the second vertical rod, wherein the gate is connected to the second vertical rod in the walking position and is disconnected from the second vertical rod in a stored position;

at least two wheelchair attachment supports adapted for removable connection to the frame of the wheelchair when the walker is in the walking position; and at least one clamp assembly associated with each of the wheelchair attachment supports, said clamp assembly adapted for removable connection of the each of the wheelchair attachment supports and the frame of the wheelchair when the walker is in the walking position, wherein the at least one clamp assembly comprises a clamp body including a recess defined by a base connecting two sides, and the clamp assembly further comprises a sliding head adapted to slide within the recess to capture and hold one of the wheelchair attachment supports and the frame of the wheelchair within the clamp body.

2. The walker according to claim 1, wherein the wheelchair attachment supports comprise an outer support tube and an inner support tube adapted to telescopically slide with respect to the outer support tube between an extended condition and a retracted condition.

3. The walker according to claim 2, wherein the supports further include a stop adapted to selectively limit a distance that the inner support tube may telescope with respect to the outer support tube.

4. The walker according to claim 2, wherein the extended condition of the wheelchair attachment supports correspond to the walking position of the walker, and wherein the retracted condition of the wheelchair attachment supports correspond to the stored position of the walker.

5. The walker of claim 1, wherein the first vertical rod and the second vertical rod each include a wheel at a bottom and a handle at the top, said handle adapted for gripping by the user when the walker is in the walking position.

6. The walker of claim 1, further including a retainer adapted to attach the gate to one of the wheelchair attachment supports when the walker is in the stored position.

7. A walker for use by a user, said walker adapted for connection to a wheelchair including a frame, the walker comprising:

two vertical rods adapted to assist in supporting the user when the walker is in a walking position;

a gate rotatably connected to a first of the two vertical rods and removably connectable to a second of the two vertical rods, wherein the gate is connected to the second of the two vertical rod in the walking position and is disconnected from the second of the two vertical rods in a stored position; and at least two wheelchair attachment supports, each of said supports extending from a corresponding one of the two vertical rods, wherein each of the supports includes at least one clamp assembly adapted to removably connect each of the supports to the frame of the wheelchair when the walker is in the walking position;

wherein the at least one clamp assembly comprises a clamp body including a recess defined by a base connecting two sides, and the clamp assembly further comprises a sliding head adapted to slide within the recess to capture and hold one of the wheelchair attachment supports and the frame of the wheelchair within the clamp body.

8. The walker of claim 7, further including two braces, each of said two braces connecting one of the at least two wheelchair attachment supports to a corresponding one of the two vertical rods.

9. The walker of claim 7, wherein the two vertical rods are the only portions of the walker adapted to contact a floor beneath the walker when the walker is in the walking position.

10. The walker of claim 9, wherein each of the two vertical rods comprises a wheel, and wherein the wheel is adapted to contact the floor when the walker is in the walking position.

11. The walker of claim 7, wherein the clamp assembly further includes a screw adapted to move the sliding head within the recess.

12. The walker of claim 11, wherein the clamp body includes an aperture through said clamp body for receiving the screw, said aperture including a longitudinal axis forming an angle greater than zero degrees with the base of the clamp body.

13. A walker for use by a user, said walker adapted for connection to a wheelchair including a frame, the walker comprising:

a first vertical rod and a second vertical rod adapted to assist in supporting the user when the walker is in a walking position;

a gate rotatably connected to the first vertical rod and removably connectable to the second vertical rod, wherein the gate is connected to the second vertical rod in the walking position and is disconnected from the second vertical rod in a stored position; and at least two telescoping wheelchair attachment supports, each of said supports extending posteriorly from one of the first vertical rod or the second vertical rod and adapted for removable connection to the frame of the wheelchair, wherein the telescoping wheelchair attachment supports are in an extended condition when the walker is in the walking position and are in a retracted condition when the walker is in the stored position;

wherein each of the at least two telescoping wheelchair attachment supports includes an outer tube and an inner tube adapted to move longitudinally with respect to each other, and further including at least one bearing between the outer tube and the inner tube.

14. The walker of claim 13, further including at least one stop adapted to limit relative movement of the inner tube with respect to the outer tube.

15. The walker of claim 14, wherein in the walking position, the supports are attached to the frame of the wheelchair and are telescopically extended to the at least one stop.

* * * * *